United States Patent [19]

Novotny

[11] 3,955,684

[45] May 11, 1976

[54] ROTARY CRANE STRUCTURE WITH A SELECTIVE DRIVE ON POWER UNIT

[75] Inventor: Carl F. Novotny, Greenfield, Wis.

[73] Assignee: Harnischfeger Corporation, Milwaukee, Wis.

[22] Filed: Feb. 6, 1975

[21] Appl. No.: 547,753

[52] U.S. Cl. ..... 212/48; 212/28; 212/144

[51] Int. Cl.[2] ..... B66C 23/72

[58] Field of Search ..... 212/28, 55, 66, 54, 212/48, 144, 47

[56] References Cited

UNITED STATES PATENTS

| | | | |
|---|---|---|---|
| 3,485,383 | 12/1969 | Beduhn | 212/48 |
| 3,777,900 | 12/1973 | Brewer | 212/58 R |
| 3,868,022 | 2/1975 | Greenlay et al. | 212/48 X |

FOREIGN PATENTS OR APPLICATIONS

| | | | |
|---|---|---|---|
| 1,345,148 | 10/1963 | France | 212/48 |

*Primary Examiner*—Robert J. Spar
*Assistant Examiner*—R. B. Johnson
*Attorney, Agent, or Firm*—James E. Nilles

[57] ABSTRACT

A rotary crane assembly of the type which is stationarily supported on the ground and which assembly includes a large mounting ring on which a revolvable frame is supported for revolving about a generally vertical axis. The revolvable frame has an upwardly extending boom and also a mast, both of which can be vertically positioned between a horizontal position and an upwardly extending working position. The assembly also includes a mobile power unit which can be driven up on the frame and located diametrically opposite above the ring from that side on which the mast and boom are pivotably mounted. Thus, the mobile power unit is secured in place on the frame and provides the power and counterbalancing for the boom and mast and by means of which the boom and mast can be erected. The mobile power unit may be of either the endless track type or rubber track type and a self-propelled unit having a lower ground engaging portion and an upper revolvable portion containing the host drums.

13 Claims, 13 Drawing Figures

ROTARY CRANE STRUCTURE WITH A SELECTIVE DRIVE ON POWER UNIT

BACKGROUND OF THE INVENTION

The invention pertains to large, stationary, rotary cranes of the type which are assembled on the job site and which can be disassembled after use and moved to a different location. These rotary cranes have a boom and a mast for swinging between a generally horizontal position from which they are erected to an upwardly extending, working position. A mobile, self-propelled power unit is provided for furnishing the power for erecting the boom and mast and also usually provides the power for the main hoist drum that vertically positions the load.

The rotary type cranes of a general type to which the present invention pertains utilizes counterbalancing means for the mast and boom. These cranes are of enormous size, the boom often extending hundreds of feet into the air and are used for moving extremely heavy equipment.

An example of a prior art device of this general character is shown in the U.S. Pat. No. 3,485,383 issued Dec. 23, 1963 and entitled "Axial Support for Cranes." Other examples of prior art rotary crane structures, but which do not employ a large supporting ring are shown in the U.S. Pat. Nos. 3,868,022 issued Feb. 25, 1975 and entitled "Self-Propelled Heavy Duty Mobile Crane" and which has been assigned to an assignee common with the present invention; U.S. Pat. No. 3,842,984 issued Oct. 22, 1974 and entitled "Crane Counter-Balancing Trailer Assembly," and U.S. Pat. No. 3,836,010 issued Sept. 17, 1974 entitled "Counter-Balancing Crane Structure."

SUMMARY OF THE PRESENT INVENTION

The present invention provides a stationary crane assembly having a large supporting ring on which is revolvably mounted about a generally vertical axis a large frame. Mounted on one portion of the frame and generally over one side of the large ring are the boom and the mast while also mounted on the frame and generally above that portion of the ring which is diametrically opposite the mounting of the boom and mast is a mobile power unit which can be driven up on the frame and secured in place. The arrangement is such that the mobile power unit provides the power means, through suitable reeving, for erecting the mast and boom. Thus, a large stationary, rotary crane assembly is provided which can be readily disassembled and moved to another job site as required. The mobile power unit acts to counter-balance the boom and the mast and the weight supported by the boom and the downward, vertical thrust of the boom, mast and load are carried directly by the large ring supported on the ground. The arrangement furthermore is such that the boom and mast are initially positioned in a horizontal position adjacent the ring with their one end pivotally mounted to the frame on the ring. The mobile power unit which has been driven up onto the frame and in a diametrically opposite position on the ring from that of the mounting for the boom and mast, provides the power for raising or erecting the mast and boom in a sequence of operations which greatly facilitates erection of cranes of this type.

These and other objects and advantages of the present invention will appear hereinafter as this disclosure progresses, reference being had to the accompanying drawings.

BRIEF DESCRIPTION OF THE DRAWINGS

FIG. 5 is a vertical sectional view taken along the line 5—5 in FIG. 2 but on an enlarged scale and furthermore showing certain parts as being removed or broken away for the sake of clarity;

FIG. 6 is a fragmentary, plan view taken generally from the line 6—6 in FIG. 5;

FIG. 7 is a vertical sectional view taken along the line 7—7 in FIG. 6;

FIG. 9 is a side elevational view of the crane showing the mobile power unit being driven onto the fixed ring and showing the boom in the position it occupies along the ground and with the mast laying on top of the boom but with its sections not pinned together;

FIG. 10 is a view similar to FIG. 9 but showing the mobile power unit when it has been driven onto the stationary ring and when the mast sections have been pinned together and the mast is beginning to be raised by the power source on the mobile unit;

FIG. 11 is a view similar to FIG. 10 showing the mast in a further raised position and when the pendent between the mast tip and the boom tip has been drawn taut;

FIG. 12 is a view similar to FIG. 11 and showing the mast and boom when further raised, the mast having been raised to the normal operating position and locked in place with its back stop;

FIG. 13 shows the mast in full lines when further moved to its normal operating position and when its back stop has been locked in place; the boom is shown in broken lines when it has again been lowered where it can then be reeved and then again raised to the fully reeved position.

DESCRIPTION OF THE PREFERRED EMBODIMENT

Figures 5, 6, 7:
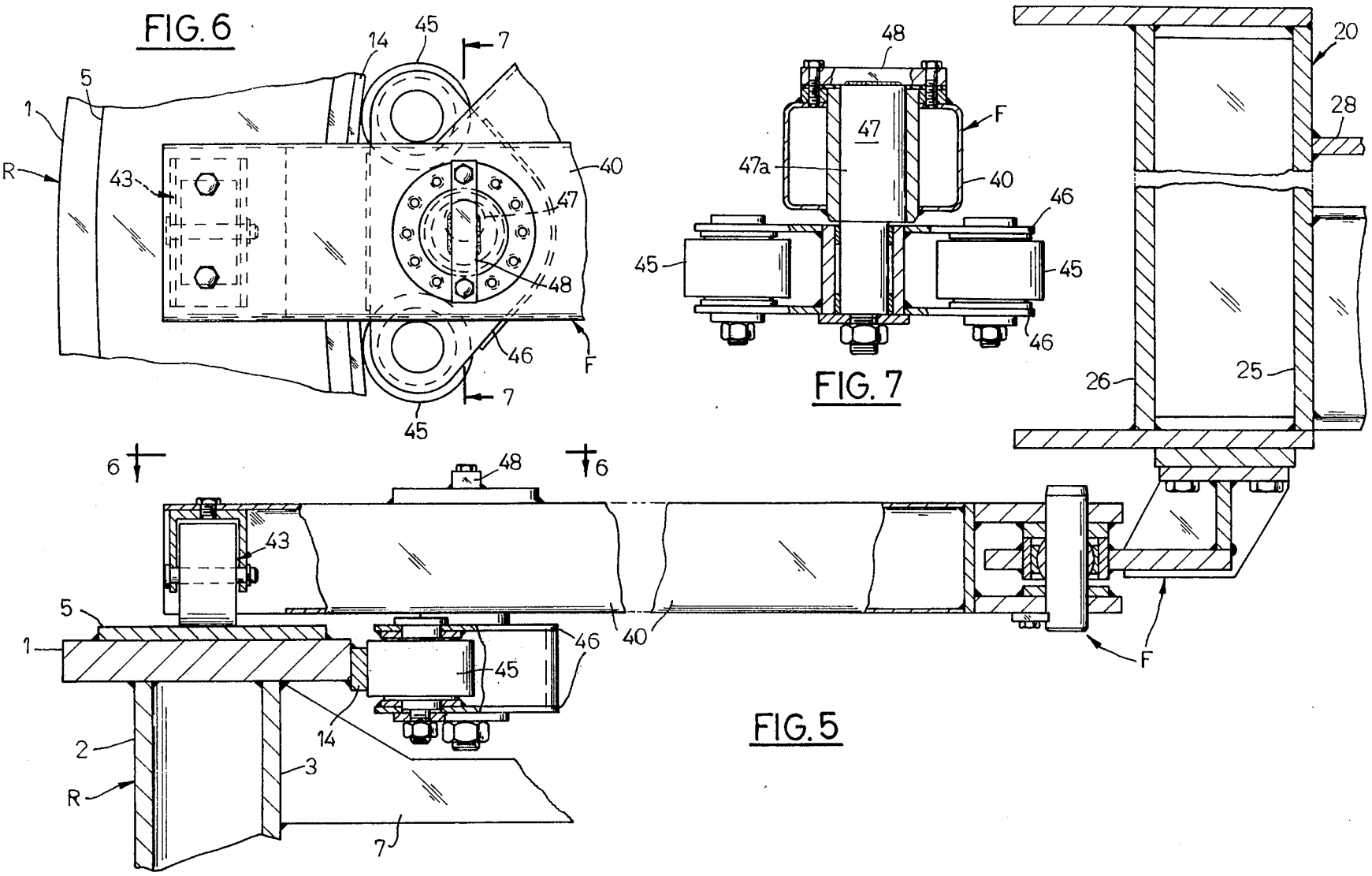
FIGS. 5, 6, and 7 are fragmentary, enlarged views of the guide wheels and their eccentric cam adjustment.
Figure 8:
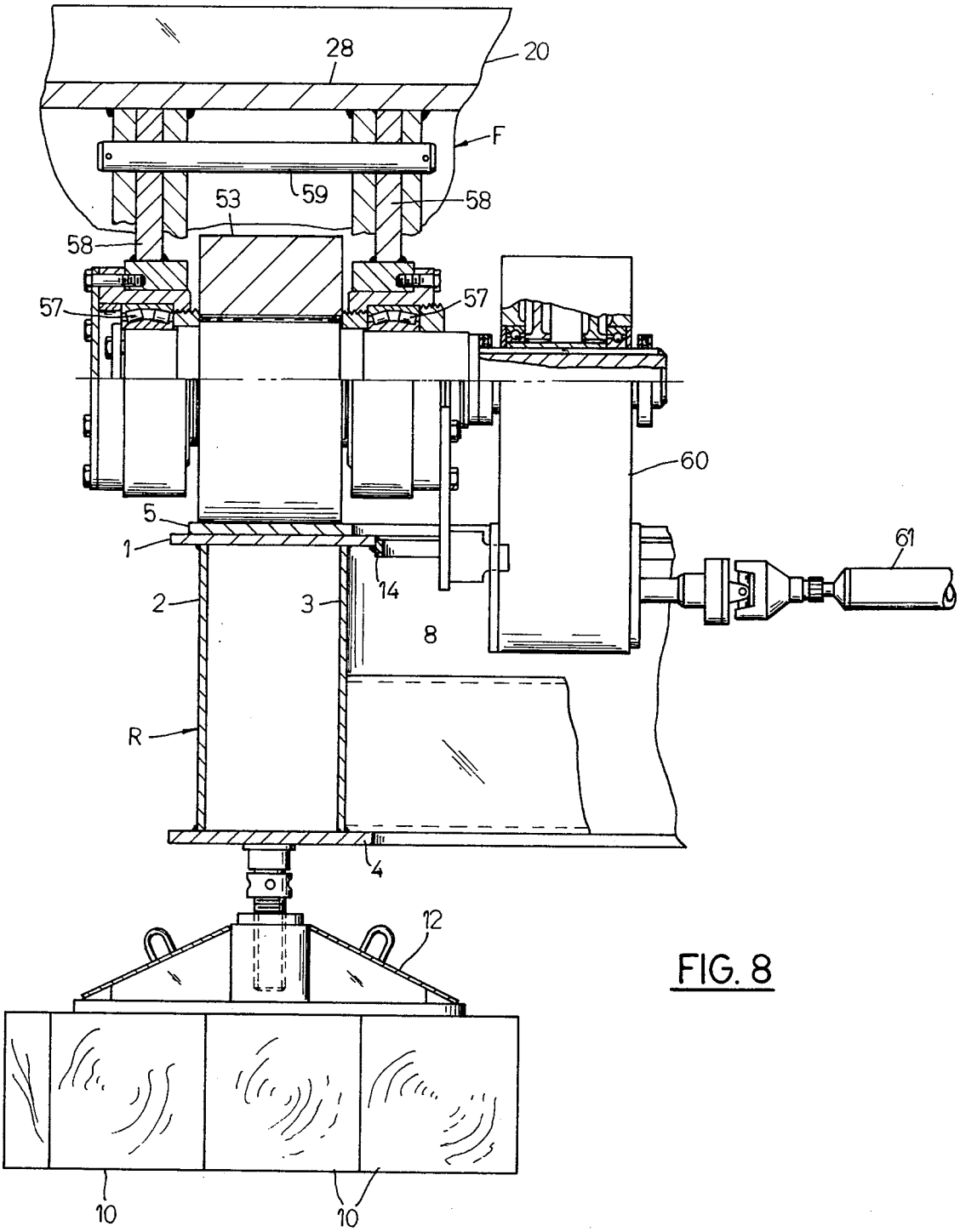
FIG. 8 is a vertical sectional view taken along line 8—8 in FIG. 2, but on an enlarged scale and showing certain parts as being broken away or removed for the sake of clarity in the drawings.

The general arrangement of the rotary crane assembly includes a large ring R which is fabricated as a rectangular box structure and which includes an upper generally horizontal ring plate 1 which is welded to vertically extending side walls 2 and 3 (FIGS. 5 and 8). The ring also includes a horizontal bottom ring plate 4 to which the side walls 2 and 3 are also welded in any suitable manner. A wheel ring plate 5 is secured to the upper surface of the ring plate 1.

Figure 2:
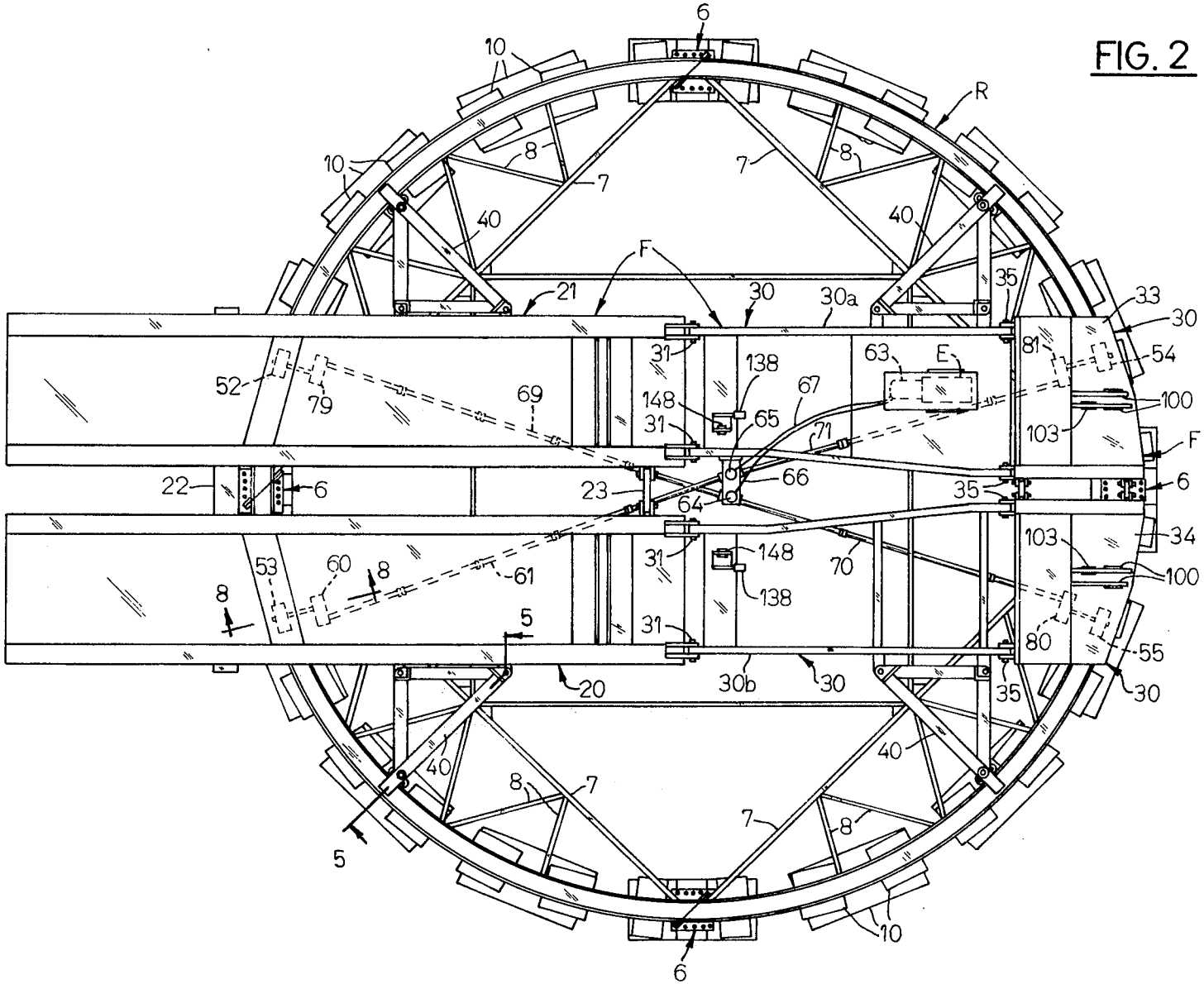
FIG. 2 is a plan view of the stationary ring shown in FIG. 1, but on an enlarged scale, certain parts being shown as removed for the sake of clarity.
Figure 3:
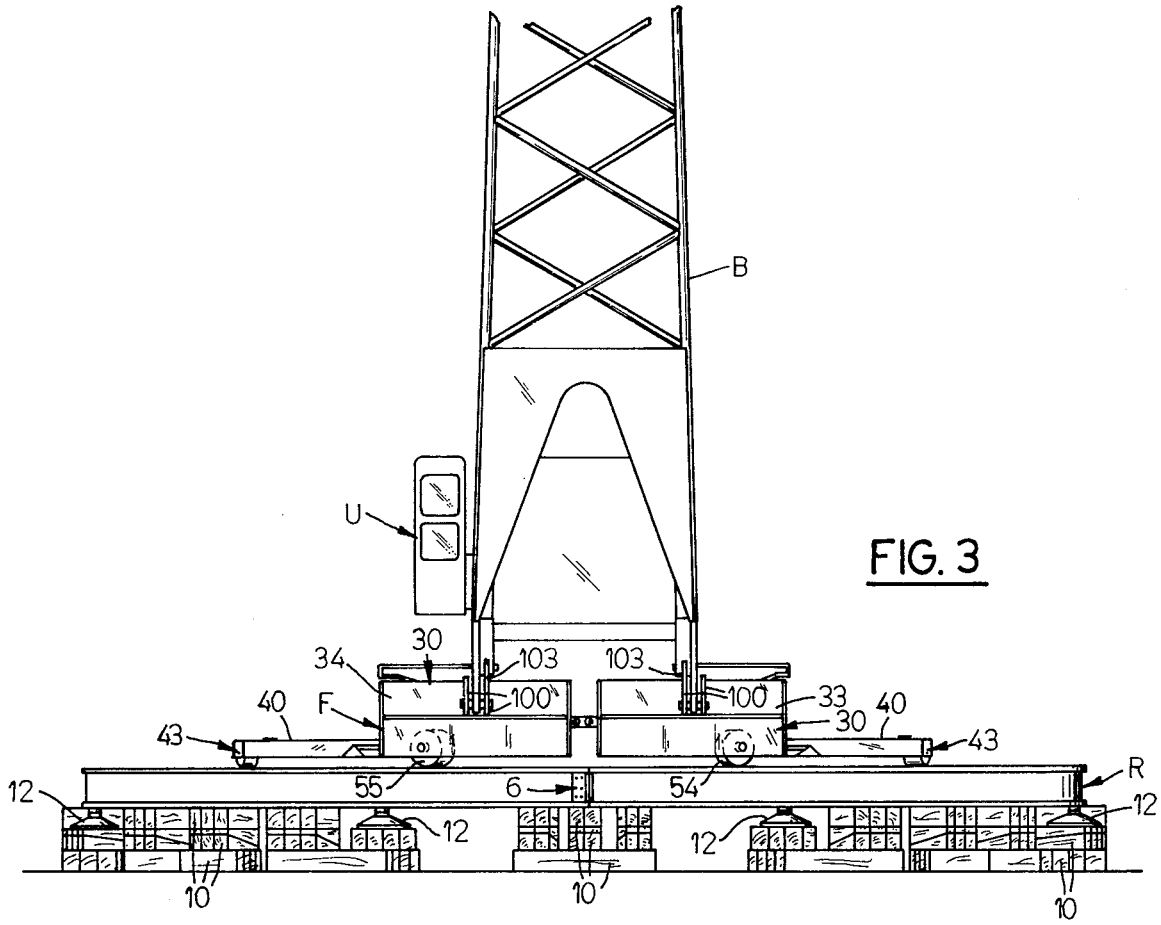
FIG. 3 is a front elevational view of the crane shown in FIG. 1, the view being taken generally from the line 3—3 in FIG. 1, but on an enlarged scale.
Figure 4:
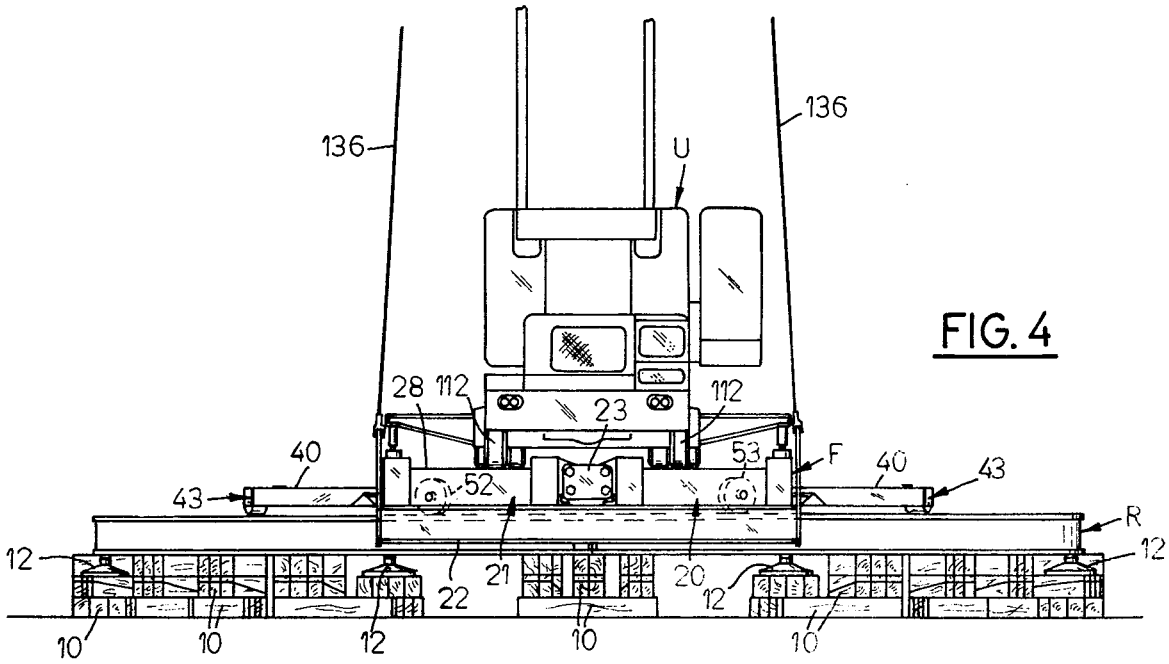
FIG. 4 is a rear elevational view of the assembly shown in FIG. 1 taken generally along the line 4—4 in FIG. 1, but on an enlarged scale.

The ring generally is fabricated in 90 degree arcuate sections, the ends of which are secured together in any suitable manner as by the bolt assemblies 6 (FIGS. 2 and 3). These arcuate sections are furthermore reinforced by cord members 7 and bracing struts 8 all suitably and rigidly secured together in any suitable manner and which thus provide rigid, arcuate sections that comprise the large ring R.

The large ring R is supported on the ground in a level, horizontal position by means of suitable blocks 10 and adjustable jacks 12 (FIG 8). It will be understood that such a ring is of considerable size and is assembled on the job site. The large ring also has an inner track-like member 14 secured around the interior edge of the plate ring 1 as by welding. It is against this track-like member 14 that guide rollers of a revolvable frame to be described, rotatably abut.

A frame structure F is revolvably mounted on the ring and about a generally vertical axis and has supporting wheel assemblies which rest on the ring and which permit rotation of the revolvable frame structure relative to the ring. As will appear in more detail, drive wheels are also carried by the revolvable frame structure and are engagable with the ring for providing driving power to the frame structure so that it can be rotatably driven around the ring in either direction. A power source is also carried on the frame for the drive wheels all of which will now be described in greater detail.

The frame structure includes a pair of parallel and horizontally disposed frames 20 and 21 each of which are similar in construction and detachably and rigidly secured together by cross braces 22 and 23. As the construction of members 20 and 21 is similar, a detailed description of member 20 is deemed to be sufficient. Member 20 as shown in FIG. 5 includes side rails 25 and 26 each of which are fabricated of box-like construction. The steel members 20 and 21 are then in turn rigidly connected together by the steel plate 28 which forms a runway on which the mobile power unit to be described can be driven onto and secured thereto in a working position. The frame also includes a detachable forward portion 30 comprised of two subframes 30*a* and 30*b* which are detachably connected to the members 20 and 21 by four pins 31. Portion 30 includes two steel box sections 33 and 34 detachably connected to frames 30*a* and 30*b* by four pins 35. It should be understood that frame components 20, 21, 30*a*, 30*b*, and 33, 34 are all rigidly secured together to form a rigid generally horizontal frame F which is revolvable on the ring R.

The frame F includes four outwardly extending, generally horizontal members 40 which are of triangular shape when viewed in plan and which are rigidly attached to the remainder of the frame as clearly shown in FIG. 5. At the outer end of members 40, there is located a wheel assembly 43 which rides on top of the ring R. Member 40 also includes pairs of guide wheels 45 which pairs are rotatably mounted in an adjustable bracket 46, the adjustable bracket 46 in turn is secured to the outer end of the member 40 by means of a vertically extending eccentric shaft 47 (FIG. 7). More particularly, the shaft 47 has an upper portion 47*a* to which is welded a steel bar 48. The lower portion of eccentric shaft 47 is eccentrically formed and extends through the bracket 46. By removing the bolt means 49, the bar and its shaft 47 can be rotated so as to vary the thrust of the eccentric portion of the shaft 47, thereby varying the position of bracket 46 and its wheels 45 so as to insure that the wheels 45 bear snugly in rolling relationship with the inner edge 14 of the ring R. In this manner, the frame F can be centrally located and properly positioned relative to the ring so that no looseness occurs between the ring and frame but rather the frame is guided smoothly and accurately around the ring. The guide wheels which are mounted on the structure are engagable with the ring to maintain proper driving relationship between the frame structure and the ring and the adjustable cam means permits the guide wheels to be radially positioned with respect to the ring for centering the frame structure in proper driving relationship.

The frame structure also has four drive wheels 52, 53, 54 and 55 (for example, see FIG. 8) which ride on top of the ring and are power driven so as to drive the frame around the ring. Drive wheels are mounted in suitable anti-friction bearings 57 which in turn are supported in the depending frame structure 58 that extends downwardly from members 20, 21 and 33. The wheel supporting structures 58 can be removed by withdrawing shaft 59 for disassembly purposes in moving to a different job site, for example.

Power is furnished to the wheels through a standard gear speed reducer 60 and from a power shaft 61. As shown in FIG. 2, the frame has a power source, such as an internal combustion engine E mounted thereon and which drives a fluid pump 63. Pressure fluid is furnished to a pair of fluid motors 64 and 65 via conduits 66 and 67. The jointed power shafts 61, 69 and 70, 71 are drivingly connected between the fluid motors and to their respective gear reducers 60, 79, 80 and 81. The fluid motors can thus drive their respective drive wheels in either direction so as to rotate the frame in either direction around the ring.

The frame structure at its rearward end and just outside the ring R has transverse, rigid member 22 extending under members 20 and 21 and rigidly secured thereto, this member 22 aids in connecting members 20 and 21 together and also provides an attachment joint for vertical loading supporting guy lines to be described.

Figure 1:
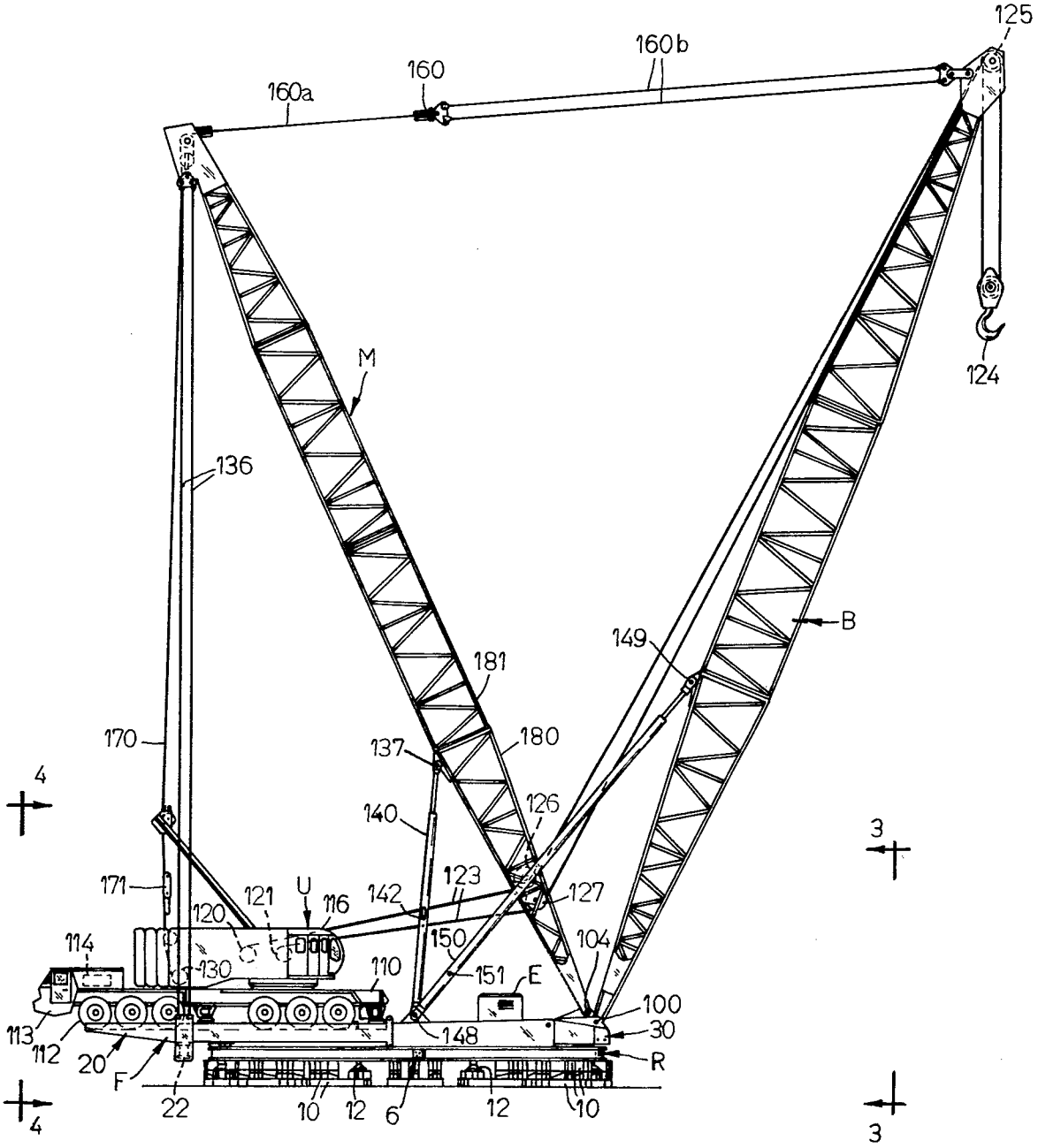
FIG. 1 is a side elevational view of a crane embodying the present invention and in the fully assembled position.

At the other end of the frame structure F are located mounting means for the ends of the mast M and boom B, these mounting means are shown in FIGS. 1, 2 and 3.

For example, the mounting means for the boom includes a pair of bifurcated brackets 100 which brackets are spaced apart transversely as shown in FIGS. 2 and 3. The mounting means for the mast also includes a pair of transversely spaced brackets 103. The mast and boom are thereby pivotally mounted to the frame structure above the ring R and at one side of the ring R. The mast and boom in effect are pivotally mounted about generally horizontal axes for swinging between the generally horizontal position shown in FIG. 9 and the upright, erected working position shown in FIG. 1.

The mobile power unit U may be of different types, for example, it may be of the endless track laying but has been shown herein as a rubber tired truck crane unit having a lower frame 110 mounted on ground wheels 112 and having an operator's cab 113 and an internal combustion engine 114 for rendering its propelling action. The unit also includes a revolvable upper 116 which revolves about a vertical axis on the frame 110 in the known manner. The upper 116 includes a pair of main hoist drums 120 and 121 which are connected by the load line 123 to the load hook 124 after being trained over the boom point sheave means 125 and around idler pulleys 126 and 127 carried adjacent the lower end of the mast M.

The revolvable upper 116 of the unit U also has a boom hoist drum 130 which is also power driven by the unit U and which may be used to erect the mast and the boom for example through the series of steps shown in FIGS. 9 to 13, as will appear.

When the boom and mast are fully assembled as shown in FIG. 1, the vertical load carrying guy lines 136, previously referred to, are connected between the upper end of the fixed mast M and the load carrying member 22 beneath the frame F. The mast is secured by a pair of telescopeable but fixed back stops 140 pivotably secured between the mast and the frame F, as at 137 and 138, respectively. The back stops 140 are of conventional character and it is believed sufficient to say that their length can be fixed when in the position in FIG. 1 by insertion of pins 142 through its telescoping members.

A pair of similar back stop members 150 are connected between the boom and the frame F, as at 148 and 149, respectively. The pins 151 render the back stops rigid to support the boom in the position shown.

The upper ends of the boom and mast are connected together by conventional upper tackle 160 sometimes referred to as a spreader and generally member 160 may include a conventional bridle **160*a* and the guy lines 160*b***.

Figure 12:
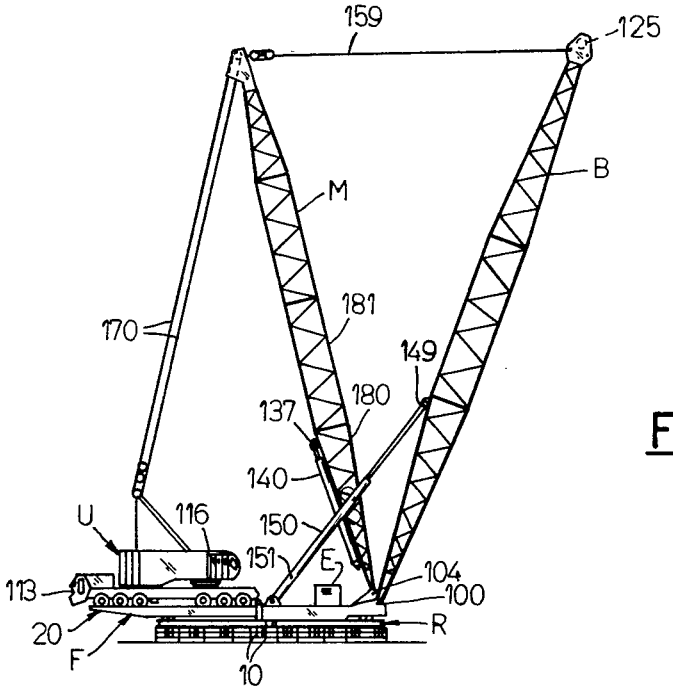

As furthermore shown in FIG. 1, the upper end of the mast is connected by other reeving 170 and may include a lower bridle 171. Generally, when the mast and boom are being erected, as shown in FIG. 12 the lower tackle bridle is located at the lower end of the reeving 170.

Figure 9:
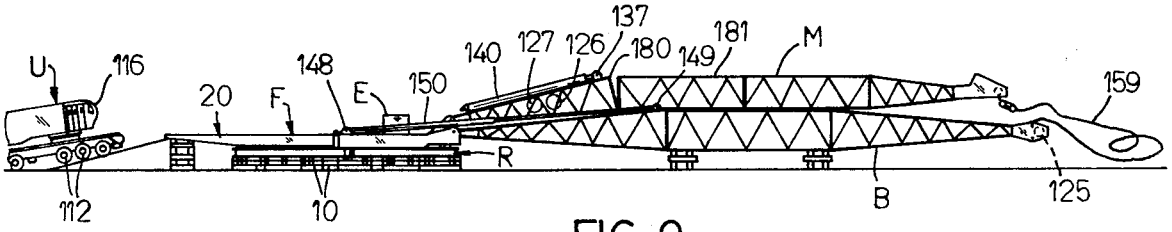
FIGS. 9 to 13 are reduced, side elevational view of the crane shown in FIG. 1, and showing the various positions of the parts for the erection.

As shown in FIGS. 9 to 13, the mast and boom can be raised from a generally horizontal position where they are initially supported on the ground to the upper fully erected position shown in FIG. 1. More specifically, as shown in FIG. 9, the mast M is resting on the boom B, but its sections have not been fully connected together. The power unit U is driven onto frame F so it can be used to raise the mast through the flexible lines. This causes line 170 to raise the mast tip.

Figure 10:
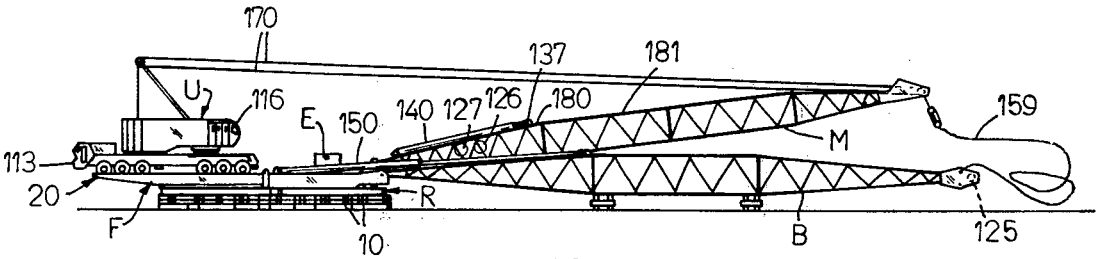

As shown in FIG. 10, the lowermost section 180 of the mast is then fully pinned to the upper section 181 of the mast and the reeving 170 begun to raise the mast off the boom.

Figure 11:
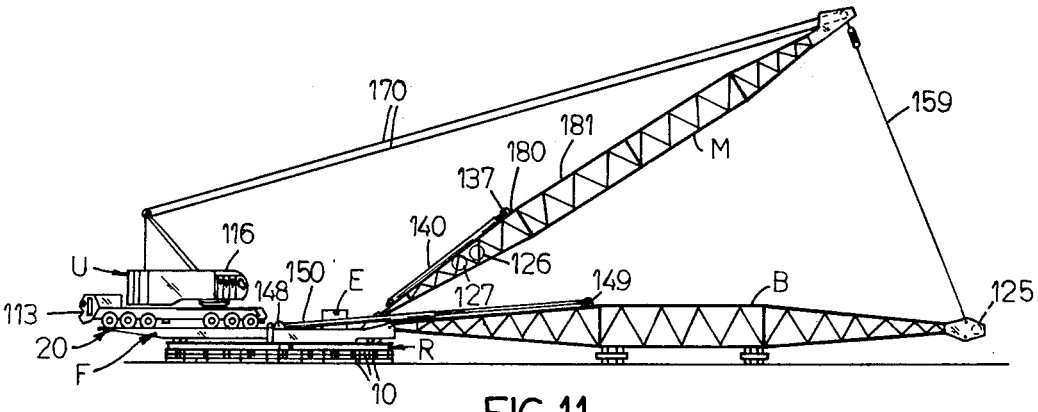

When the erection process has reached the position shown in FIG. 11, that is, when the boom hoist drum 130 has raised the mast to the position shown, the fixed length pendant or line 159 has become taut. Further upward movement of the mast M causes the boom to be raised and as shown in FIG. 12 the boom has then been raised to its operating position and its back stop 150 has been pinned in a rigid manner as previously mentioned. Further rearward movement of the mast, due to the extending action of the bridle **160*a* causes the mast to assume its operating position shown in FIG. 13, where its back stops 140** are also pinned in the operating position.

Figure 13:
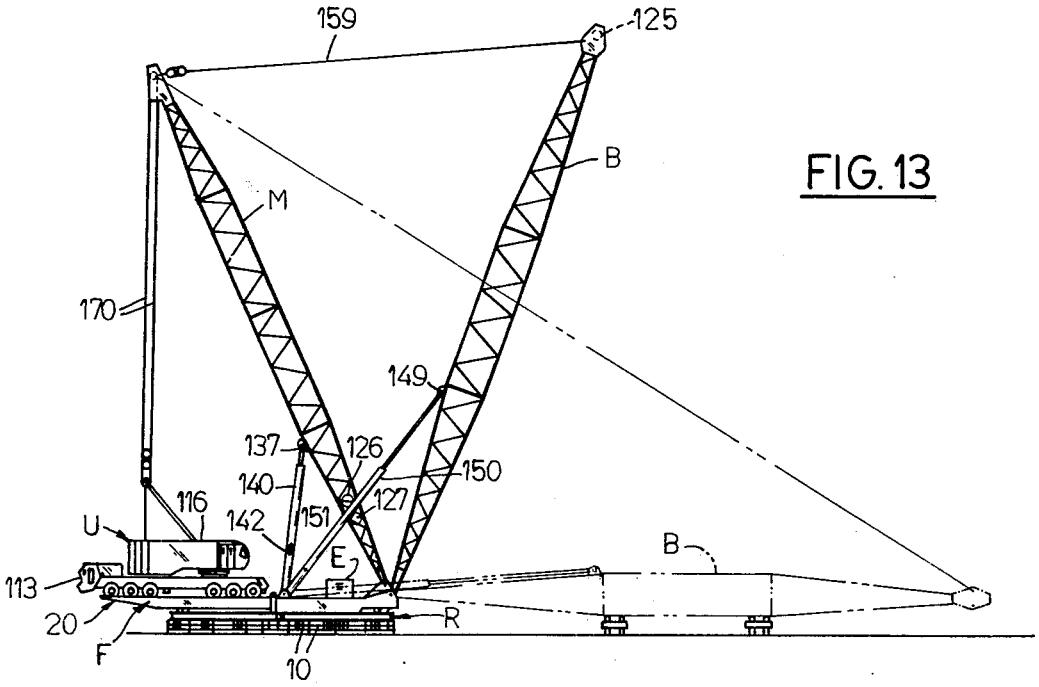

As shown by the broken lines in FIG. 13, the back stop pin 151 has been removed and the boom has again been lowered from the full line position shown in FIG. 13 so that the boom can be fully reeved for its load carrying function. The fully reeved boom is then raised to the full line position shown in FIG. 13 by means of the boom hoist drum 130.

I claim:

1. A rotary crane assembly comprising; a ring supported generally horizontally on the ground, a frame structure revolvably mounted on said ring about a generally vertical axis, wheel assemblies to thereby permit rotation of said revolvable frame structure on said ring, power means for rotationally driving said frame structure in either direction, a power unit drivable onto said revolvable frame structure and secured thereto for rotation therewith and located generally over and adjacent one side of said ring, a boom pivotally mounted to said frame structure adjacent that side of said ring which is generally diametrically opposite to said power unit, said boom being swingable about a generally horizontal axis between a generally horizontal position and an upwardly extending working position, a mast pivotally mounted on said structure and about a generally horizontal axis and adjacent the point of pivotal mounting of said boom to said structure, said mast being vertically swingable between (1) a generally horizontal position where it can rest above said boom when the latter is in a horizontal position and (2) an upwardly extending working position, said power unit having power hoist means for said mast and boom for vertically swinging said mast and boom, and means for securing said mast and said boom to said structure in said working position.

2. The crane assembly set forth in claim 1 further characterized in that said power means in a fluid pump, said assembly also including fluid motor means connected to said frame structure and in fluid communication with said fluid pump, and drive shaft means connected between said fluid motor means and at least some of said wheel assemblies for driving the frame structure in either direction of rotation.

3. A crane assembly as set forth in claim 1 including guide wheels mounted on said structure and engageable with said ring for maintaining proper driving relationship between said frame structure and said ring, and adjustable means for said guide wheels for radially positioning the latter with respect to said ring for centering said frame structure in proper driving relationship in respect to said ring.

4. A crane assembly as set forth in claim 2 including guide wheels mounted on said structure and engageable with said ring for maintaining proper driving relationship between said frame structure and said ring, and adjustable means for said guide wheels for radially positioning the latter with respect to said ring for centering said frame structure in proper driving relationship in respect to said ring.

5. The assembly as described in claim 1 including flexible lines connected between said power hoist means, said boom and said mast for raising said mast and boom to the upright positions and for permitting said boom to be swung vertically and independently of said mast.

6. A stationary crane assembly comprising; a mounting ring supported in a level position on the ground, a frame structure revolvably mounted on said ring about a generally vertical axis and having supporting wheel assemblies to thereby permit rotation of said revolvable frame structure, drive wheels carried by said frame structure and engageable with said ring for revolving said frame around said ring, a power source for said drive wheels; a mobile, self-propelled power unit drivable onto said revolvable frame structure and secured thereto for rotation therewith and located over and generally adjacent one side of said ring, said power unit having a source of power and hoist drum means driven by said source of power; a boom pivotally mounted to said frame structure adjacent that side of said ring which is diametrically opposite to said mobile power unit, said boom being swingable about a generally horizontal axis between a generally horizontal position and an upwardly extending working position, a mast pivotally mounted on said structure and about a generally horizontal axis and adjacent the point of pivotal mounting of said boom to said structure, said mast being vertically swingable between (1) a generally horizontal position where it can rest above said boom when the latter is in a horizontal position and (2) an upwardly extending working position, back stop means for securing said mast and said boom to said structure when in their working positions, and flexible lines connected between said boom, said mast, and said drum means for raising said mast and boom from their generally horizontal positions to their upright working positions and for permitting said boom to be swung about its generally horizontal pivot point independently of said mast.

7. The crane assembly set forth in claim 6 further characterized in that said power source is a fluid pump, including fluid motor means connected to said structure and in fluid communication with said fluid pump, and drive shaft means connected between said fluid motor means and said drive wheels for driving the latter in either direction of rotation.

8. A crane assembly as set forth in claim 6 including guide wheels mounted on said structure and engageable with said ring for maintaining proper driving relationship between said frame structure and said ring, and adjustable means for said guide wheels for radially positioning the latter with respect to said ring for centering said frame structure in proper driving relationship in respect to said ring.

9. A crane assembly as set forth in claim 7 including guide wheels mounted on said structure and engageable with said ring for maintaining proper driving relationship between said frame structure and said ring, and adjustable means for said guide wheels for radially positioning the latter with respect to said ring for centering said frame structure in proper driving relationship in respect to said ring.

10. A large crane assembly for being stationarily mounted on the ground, said assembly comprising; a mounting ring stationarily mounted in a level position on the ground and forming a circular guide track, means for levelling said ring, a revolvable frame structure mounted on said ring and having supporting wheel assemblies for being driven along said guide track to thereby permit rotation of said revolvable frame structure, drive wheels carried by said frame structure and engageable on said track for revolving said frame around said ring, a power source carried by said frame and having a driving connection with said drive wheels; a mobile, self-propelled power unit drivable onto said revolvable frame structure and secured thereto for rotation therewith, said power unit secured at generally one side of said ring, said power unit having a source of power and hoist means driven by said source of power; a boom pivotally mounted to said frame structure at the side thereof which is diametrically opposite to said mobile power unit and for being swung about a generally horizontal axis between a generally horizontal position and an upwardly extending working position, a mast pivotally mounted on said structure and about a generally horizontal axis and adjacent the point of pivotal mounting of said boom and vertically swingable between a generally horizontal position where it can rest above said boom when the latter is in a horizontal position and an upwardly extending working position, back stop means for securing said mast and said boom when in their working positions, and reeving means connected between said boom, said mast, and said hoist means for raising said mast and boom from their generally horizontal positions to their upright working positions and for permitting said boom to be swung about its generally horizontal pivot point independently of said mast.

11. The crane assembly set forth in claim 10 further characterized in that said power source is a fluid pump, including fluid motor means connected to said structure and in fluid communication with said fluid pump, and drive shaft means connected between said fluid motor means and said drive wheels for driving the latter in either direction of rotation.

12. A crane assembly as set forth in claim 10 including guide wheels mounted on said structure and engageable with said ring for maintaining proper driving relationship between said frame structure and said ring, and adjustable means for said guide wheels for radially positioning the latter with respect to said ring for centering said frame structure in proper driving relationship in respect to said ring.

13. A crane assembly as set forth in claim 11 including guide wheels mounted on said structure and engageable with said ring for maintaining proper driving relationship between said frame structure and said ring and adjustable means for said guide wheels for radially positioning the latter with respect to said ring for centering said frame structure in proper driving relationship in respect to said ring.

* * * * *